US008397464B2

(12) United States Patent
Lin

(10) Patent No.: US 8,397,464 B2
(45) Date of Patent: Mar. 19, 2013

(54) MIDDLE POUR ANCHOR BOLT HOLDER

(75) Inventor: Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 386 days.

(21) Appl. No.: 12/347,869

(22) Filed: Dec. 31, 2008

(65) Prior Publication Data

US 2010/0162656 A1 Jul. 1, 2010

(51) Int. Cl.
*E04B 1/38* (2006.01)
*E04C 5/00* (2006.01)

(52) U.S. Cl. ..... 52/709; 52/701

(58) Field of Classification Search ..... 52/294, 52/295, 296, 297, 298, 701, 704, 706, 707, 52/677, 679, 681, 687, 689, 709; 248/534, 248/539

See application file for complete search history.

(56) References Cited

U.S. PATENT DOCUMENTS

| | | | | | |
|---|---|---|---|---|---|
| 991,517 | A | | 5/1911 | Kennedy | |
| 1,045,562 | A | | 11/1912 | Kennedy | |
| 1,053,255 | A | * | 2/1913 | Ward | 248/536 |
| 1,108,859 | A | | 8/1914 | Bennet | |
| 1,185,765 | A | | 6/1916 | Brooks | |
| 1,264,189 | A | | 4/1918 | Keator | |
| 1,305,692 | A | * | 6/1919 | Curry | 52/293.1 |
| 1,447,515 | A | | 6/1922 | Miller | |
| 1,714,457 | A | * | 5/1929 | Voight | 52/681 |
| 1,940,545 | A | | 12/1931 | Holmes | |
| 2,625,815 | A | | 1/1953 | Black | |
| 3,157,966 | A | | 11/1964 | Sherburne | |
| 3,304,079 | A | * | 2/1967 | Jones | 269/287 |
| 3,307,811 | A | * | 3/1967 | Anderson | 248/534 |
| 3,391,514 | A | | 7/1968 | Hall, Jr. | |
| 3,405,497 | A | | 10/1968 | McNair | |
| 3,418,781 | A | | 12/1968 | Penote | |
| 3,443,351 | A | | 5/1969 | Kumazawa | |
| 3,514,917 | A | | 6/1970 | Merrill, Sr. | |
| 3,867,804 | A | | 2/1975 | Wilson | |
| 3,884,004 | A | | 5/1975 | Douma et al. | |
| 3,896,596 | A | * | 7/1975 | Berger | 52/153 |
| 3,927,497 | A | | 12/1975 | Yoshinaga et al. | |
| 4,000,591 | A | | 1/1977 | Courtois | |
| 4,169,569 | A | | 10/1979 | Riegler et al. | |
| 4,195,709 | A | | 4/1980 | Gianotti et al. | |
| 4,287,807 | A | | 9/1981 | Pacharis et al. | |
| 4,325,575 | A | | 4/1982 | Holt et al. | |
| 4,408,940 | A | | 10/1983 | Fischer | |
| 4,412,407 | A | | 11/1983 | Melfi et al. | |
| 4,641,478 | A | | 2/1987 | Nelson, Jr. | |
| 4,838,507 | A | | 6/1989 | Fricker | |
| 4,945,704 | A | | 8/1990 | Brown, Jr. | |

(Continued)

OTHER PUBLICATIONS

Lumberlok Engineered Metal Fasteners Catalog, 1988, p. 3 and back cover, Lumberlok, Hayward, California, United States.

(Continued)

*Primary Examiner* — William Gilbert
*Assistant Examiner* — Theodore Adamos
(74) *Attorney, Agent, or Firm* — James R. Cypher; Charles R. Cypher

(57) ABSTRACT

A connection between an anchor bolt and an anchor bolt holder that is economically efficient to produce and simple to use. This object is achieved by forming the anchor bolt holder from sheet metal and shaping the anchor bolt holder so that it can be formed on an automated die with a minimum of unused material.

19 Claims, 5 Drawing Sheets

U.S. PATENT DOCUMENTS

| | | | | |
|---|---|---|---|---|
| 5,050,364 | A * | 9/1991 | Johnson et al. | 52/705 |
| 5,085,547 | A | 2/1992 | Vanotti | |
| 5,205,690 | A | 4/1993 | Roth | |
| 5,375,384 | A | 12/1994 | Wolfson | |
| 5,641,256 | A | 6/1997 | Gundy | |
| 5,653,078 | A | 8/1997 | Kies et al. | |
| 5,653,563 | A | 8/1997 | Ernst et al. | |
| 5,740,651 | A | 4/1998 | Vanotti | |
| 5,772,372 | A | 6/1998 | Lins et al. | |
| 5,937,609 | A * | 8/1999 | Roth | 52/698 |
| 5,957,644 | A * | 9/1999 | Vaughan | 411/82 |
| 6,161,339 | A | 12/2000 | Cornett, Sr. et al. | |
| 6,240,697 | B1 | 6/2001 | Thompson et al. | |
| 6,341,452 | B1 | 1/2002 | Billinghaus | |
| 6,350,093 | B1 | 2/2002 | Petersen et al. | |
| 6,513,300 | B1 | 2/2003 | James | |
| 6,658,810 | B2 * | 12/2003 | DeLoach, Sr. | 52/701 |
| 6,993,882 | B2 | 2/2006 | Crawford et al. | |
| 7,114,695 | B2 * | 10/2006 | DeLoach, Sr. | 249/18 |
| 7,150,132 | B2 | 12/2006 | Commins | |
| 7,174,679 | B1 | 2/2007 | Mueller | |
| 7,296,382 | B2 | 11/2007 | Sack | |
| 7,445,192 | B2 | 11/2008 | Gridley et al. | |
| 7,743,580 | B2 * | 6/2010 | DeLoach, Sr. | 52/708 |
| 7,946,086 | B2 | 5/2011 | Hammer et al. | |
| 7,971,411 | B2 | 7/2011 | Commins | |
| 2002/0189175 | A1 | 12/2002 | Lecelot, III et al. | |
| 2003/0070388 | A1 * | 4/2003 | Catani et al. | 52/677 |
| 2007/0028552 | A1 * | 2/2007 | DeLoach | 52/677 |
| 2011/0041449 | A1 | 2/2011 | Espinosa | |
| 2011/0041450 | A1 | 2/2011 | Espinosa | |

OTHER PUBLICATIONS

KC Metals Superspeed Connectors Catalog, at least as early as Apr. 2011, front cover, p. 76 and back cover, KC Metals Products, Inc., San Jose, California, United States.

* cited by examiner

MIDDLE POUR ANCHOR BOLT HOLDER

BACKGROUND OF THE INVENTION

A concrete slab is a common structural element of modern buildings. Horizontal slabs of steel reinforced concrete, typically between 10 and 50 centimeters thick, are most often used to construct floors and ceilings, while thinner slabs are also used for exterior paving.

In many domestic and industrial buildings a thick concrete slab, supported on foundations or directly on the sub soil, is used to construct the ground floor of a building. In high rises buildings and skyscrapers, thinner, pre-cast concrete slabs are slung between the steel frames to form the floors and ceilings on each level.

A concrete slab may be prefabricated or cast in situ. Prefabricated concrete slabs are built in a factory and transported to the site, ready to be lowered into place between steel or concrete beams. They may be pre-stressed (in the factory), post-stressed (on site), or unstressed. It is vital that the supporting structure is built to the correct dimensions, or the slabs may not fit.

In situ concrete slabs are built on the building site using formwork—a type of boxing into which the wet concrete is poured. If the slab is to be reinforced, the rebars are positioned within the formwork before the concrete is poured in. Plastic tipped metal, or plastic bar chairs are used to hold the rebar away from the bottom and sides of the formwork, so that when the concrete sets it completely envelops the reinforcement. For a ground slab, the formwork may consist only of sidewalls pushed into the ground. For a suspended slab, the formwork is shaped like a tray, often supported by a temporary scaffold until the concrete sets.

The formwork is commonly built from wooden planks and boards, plastic, or steel. On commercial building sites today, plastic and steel are more common as they save labour. On low-budget sites, for instance when laying a concrete garden path, wooden planks are very common. After the concrete has set the wood may be removed, or left there permanently.

In some cases formwork is not necessary—for instance, a ground slab surrounded by brick or block foundation walls, where the walls act as the sides of the tray and hardcore acts as the base.

When shear bolts are embedded in a concrete slab, they must be supported during the concrete pour. When shear bolts are needed away from the edges of a concrete slab, they must be supported on the underlying surface. The present invention is a free-standing anchor bolt holder that holds an anchor bolt upright during the concrete pour. If necessary, the anchor bolt holder can be fastened to the material of the underlying surface.

SUMMARY OF THE INVENTION

An object of the present invention is to provide a connection between an anchor bolt and an anchor bolt holder that is economically efficient to produce and simple to use. This object is achieved by forming the anchor bolt holder from sheet metal and shaping the anchor bolt holder so that it can be formed on an automated die with a minimum of unused material.

DETAILED DESCRIPTION OF THE INVENTION

Figure 2:
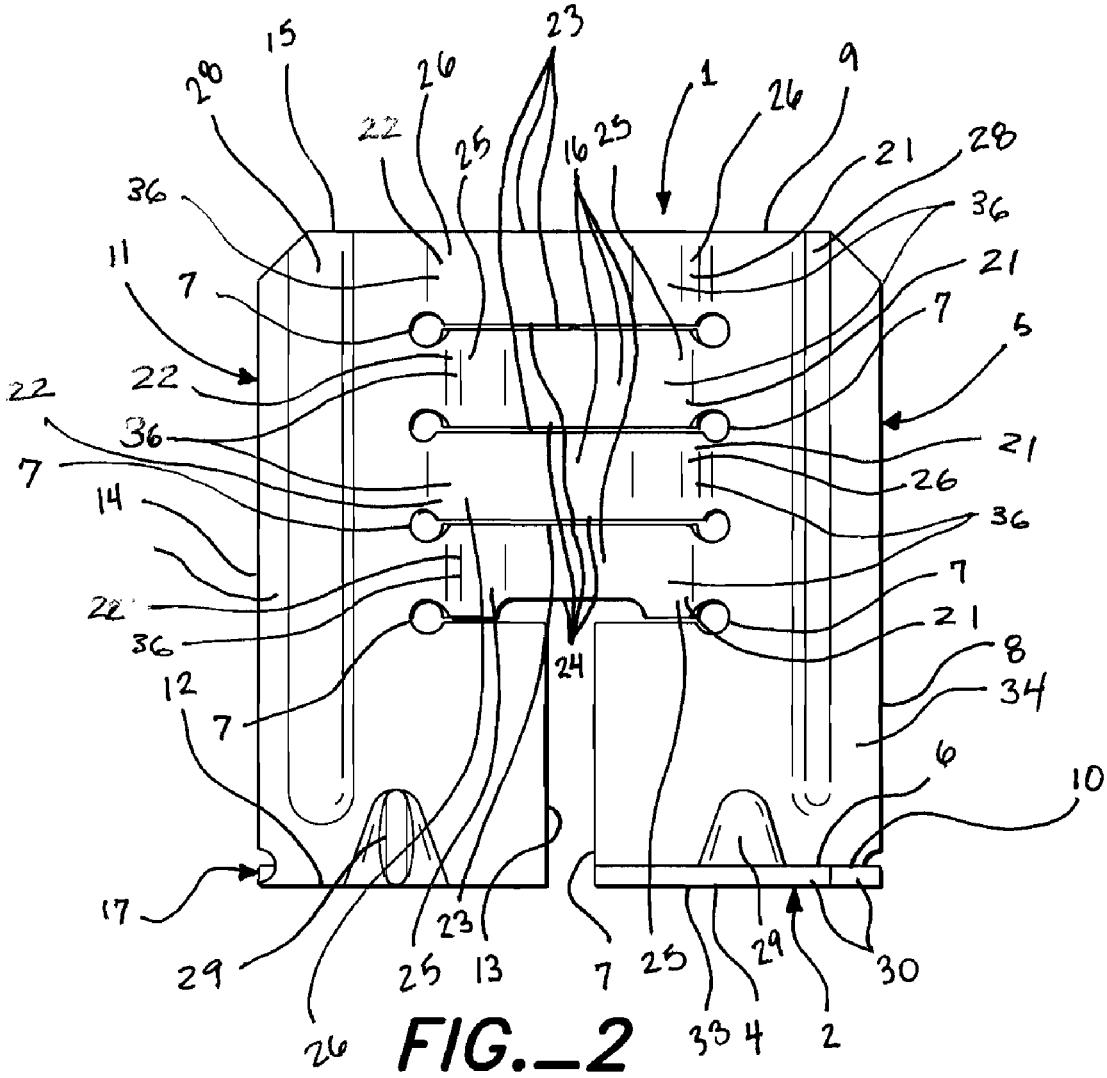
FIG. 2 is a front elevation view of the anchor bolt holder of the present invention, having a plurality of rib bands that hold the anchor bolt.
Figure 5:
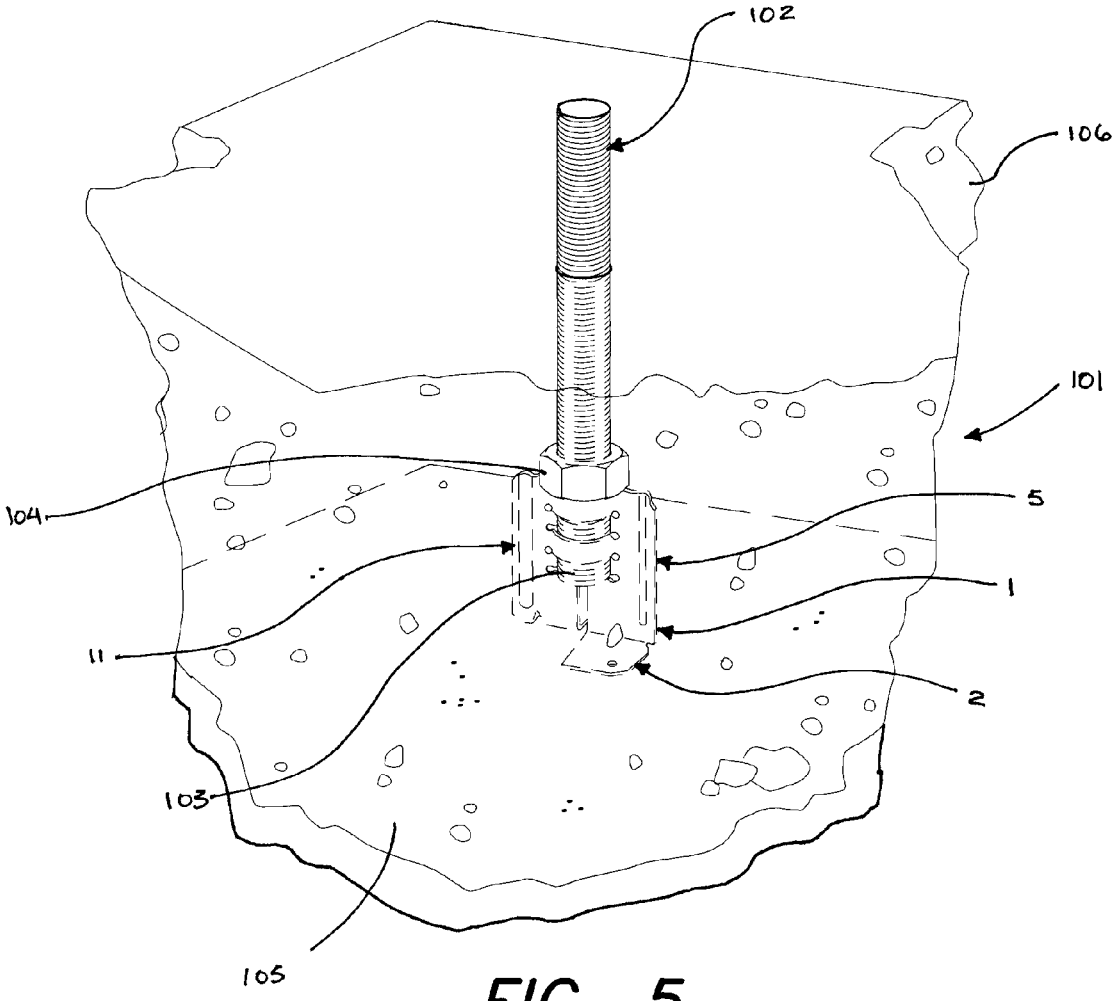
FIG. 5 is a perspective view of the anchor bolt connection of the present invention.
Figure 6:
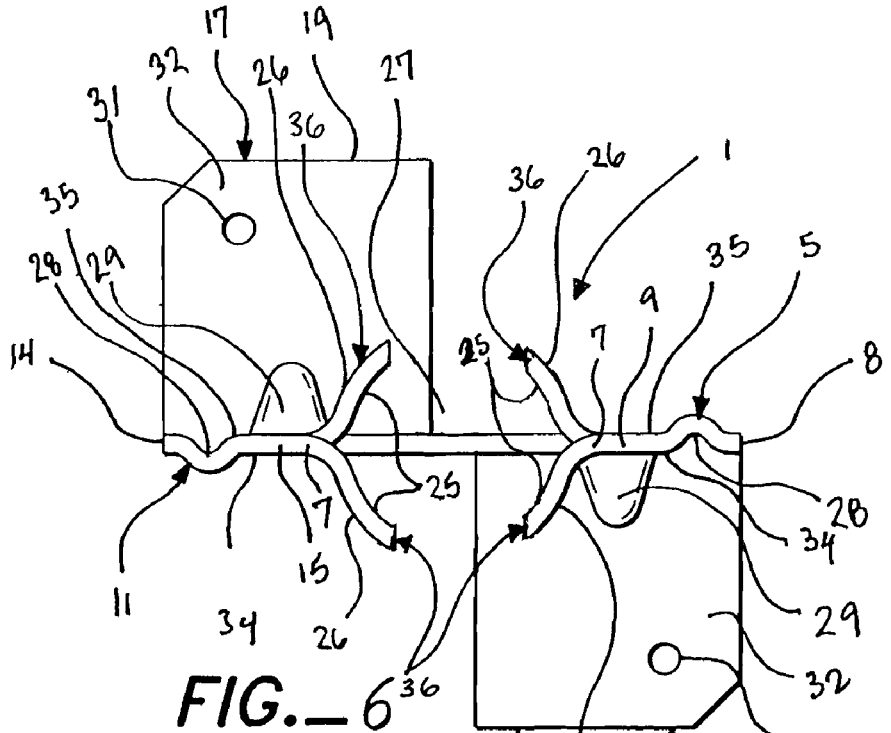
FIG. 6 is a top plan view of the anchor bolt holder of the present invention, having a plurality of arms that hold the anchor bolt.
Figure 7:
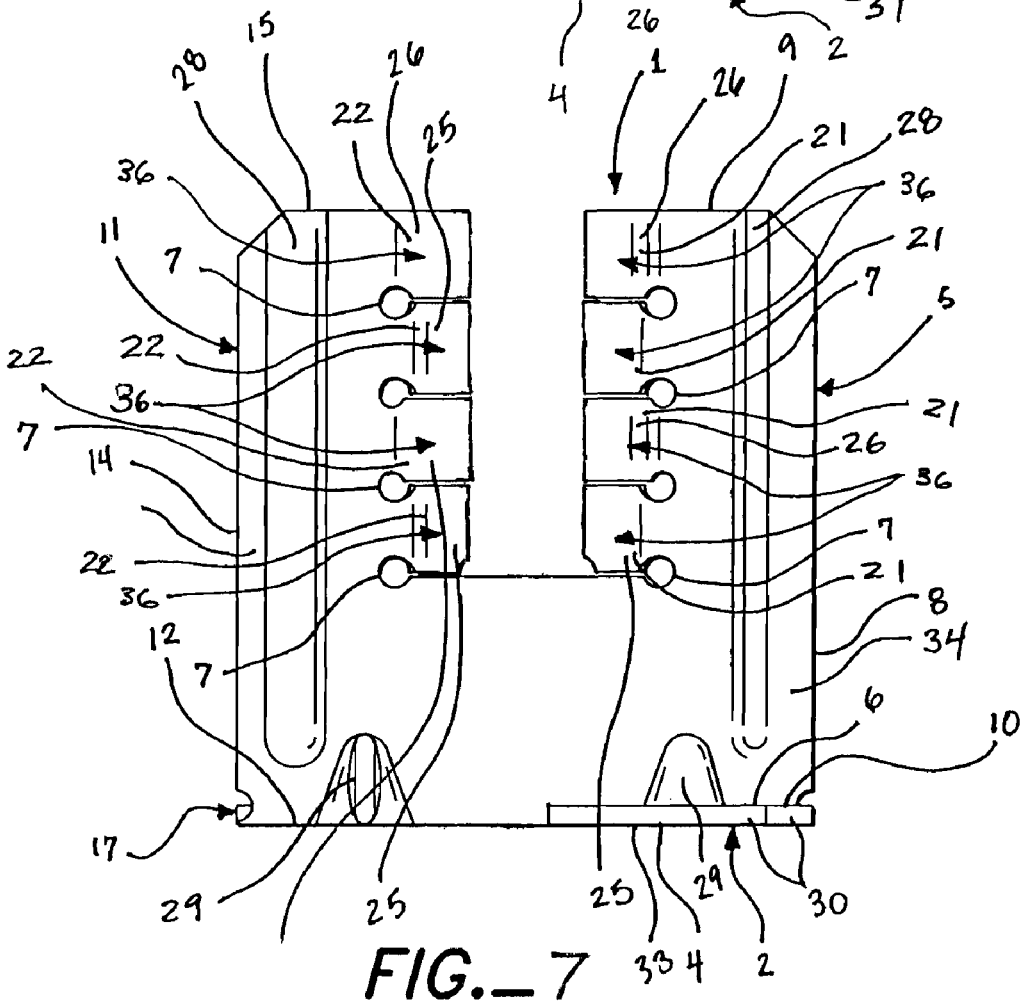
FIG. 7 is a front elevation view of the anchor bolt holder of the present invention, having a plurality of arms that hold the anchor bolt.

As shown in FIGS. 2 and 5, the present invention is an anchor bolt connection 101 comprising an anchor bolt 102 with a first end portion 103 and a sheet metal anchor bolt holder 1. The sheet metal anchor bolt holder 1 has a first foot 2, a first side member 5, a second side member 11, a second foot 17, a first plurality of arms 36, and a second plurality of arms 36.

Figure 1:
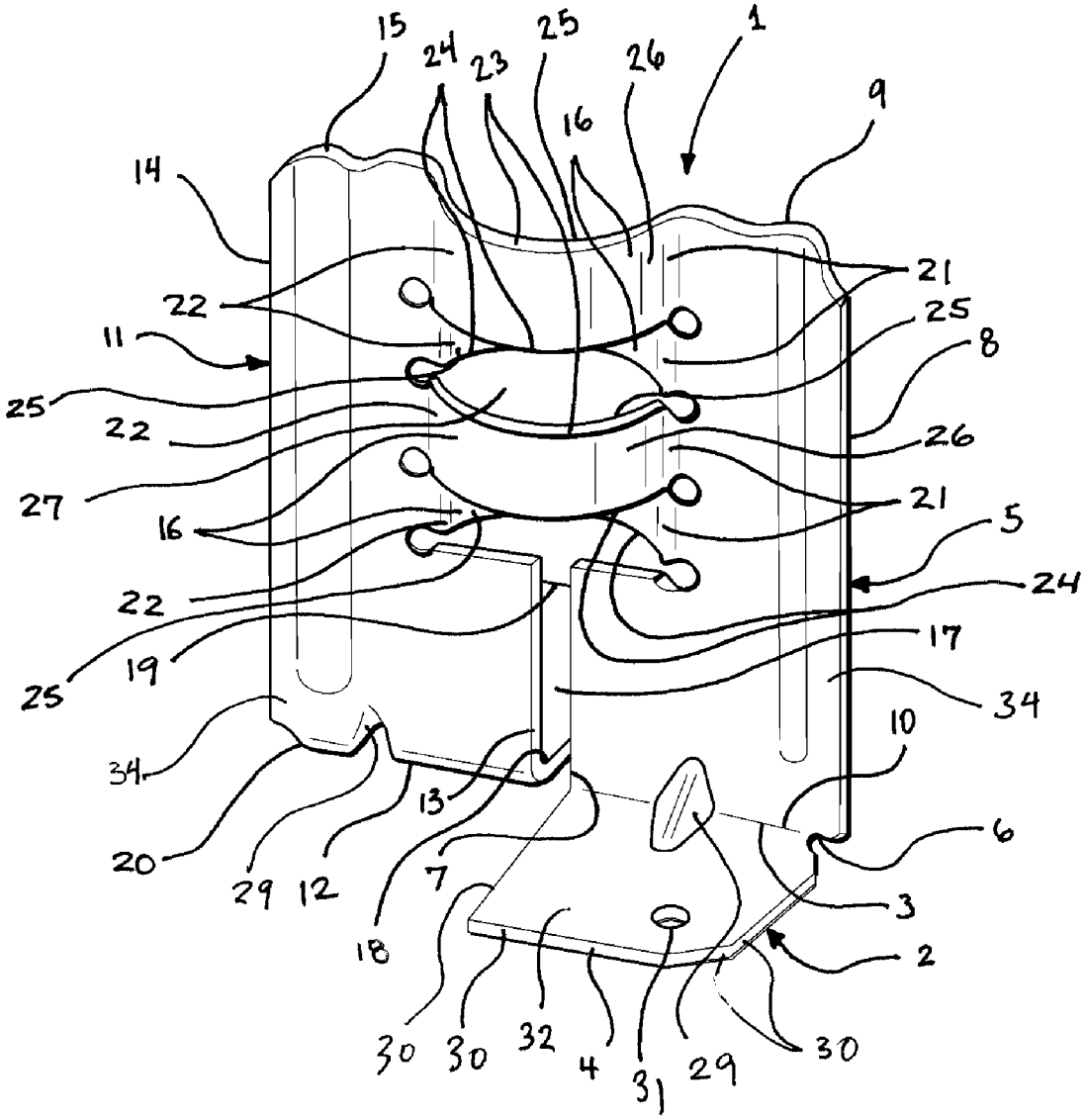
FIG. 1 is a perspective view of the anchor bolt holder of the present invention, having a plurality of rib bands that hold the anchor bolt.
Figure 3:
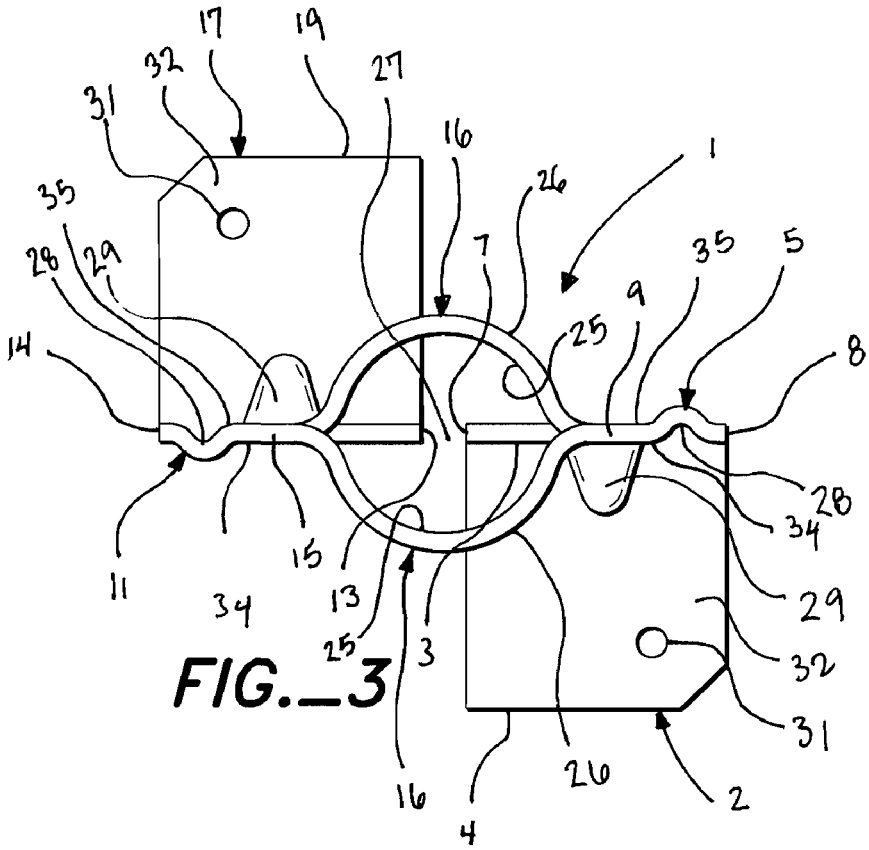
FIG. 3 is a to plan view of the anchor bolt holder of the present invention, having a plurality of rib bands that hold the anchor bolt.

As shown in FIGS. 1 and 3, the first foot 2 has an inner edge 3 and an outer edge 4. The first side member 5 has a bottom edge 6, an inner side edge 7, an outer side edge 8, and a top edge 9. The first side member 5 is integrally joined to the first foot 2 along a first bend 10 that is at least partially coincident with the bottom edge 6 of the first side member 5 and the inner edge 3 of the first foot 2. The second side member 11 has a bottom edge 12, an inner side edge 13 facing the inner side edge 7 of the first side member 5, an outer side edge 14 facing away from the outer side edge 8 of the first side member 5, and a top edge 15. The second side member 11 is integrally joined to the first side member 5. The second foot 17 has an inner edge 18 and an outer edge 19. The second foot 17 is integrally joined to the second side member 11 along a second bend 20 that is at least partially coincident with the bottom edge 12 of the second side member 11 and the inner edge 18 of the second foot 17.

As shown in FIGS. 2 and 3, a first plurality of arms 36 project from the inner side edge 7 of the first side member 5. The arms 36 each have an inner side 25 and an outer side 26. A second plurality of arms 36 projects from the inner side edge 13 of the second side member 11. The arms 36 each have an inner side 25 and an outer side 26. The inner sides 25 of the first and second pluralities of arms 36 embrace the first end portion 103 of the anchor bolt 102 and thereby define an anchor-receiving space 27.

Preferably, as shown in FIG. 2, one of the first plurality of arms 36 is integrally joined to one of the second plurality of arms 36 to form a continuous rib band 16. More preferably, another of the first plurality of arms 36 and another of the second plurality of arms 36 is integrally joined to form another continuous rib band 16. The rib bands 16 each have a first end 21 and a second end 22, the first end 21 being integrally joined to the inner side edge 7 of the first side member 5 and the second end 22 being integrally joined to the inner side edge 13 of the second side member 11. The inner sides 25 of the rib bands 16 define the anchor-receiving space 27.

Figure 4:
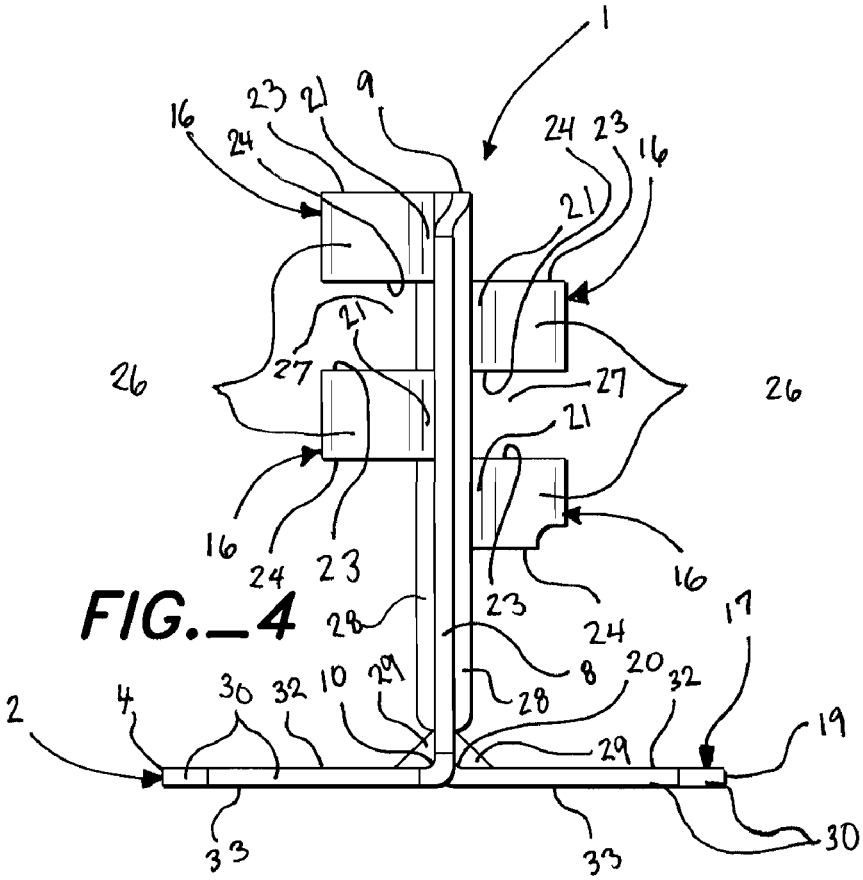
FIG. 4 is a right side elevation view of the anchor bolt holder of the present invention, having a plurality of rib bands that hold the anchor bolt.

As shown in FIGS. 2 and 4, the rib bands 16 preferably are arched. Preferably, the arched rib bands 16 each have an upper edge 23 and a lower edge 24, the upper edge 23 and second lower edge 24 both extending from the first end 21 to the second end 22. The inner side 25 is generally concave and the outer side 26 is generally convex. The arched rib bands 16 alternately arch in opposite directions to define the anchor-receiving space 27 encompassed by the generally concave inner sides 25.

Preferably, as shown in FIGS. 2 and 3, the first side member 5 is stiffened with an embossment 28 that extends more than half the distance between the bottom edge 6 and the top edge 9 of the first side member 5. Preferably, the second side member 11 is also stiffened with an embossment 28 that extends more than half the distance between the bottom edge 12 and the top edge 15 of the second side member 11.

As shown in FIGS. 1 and 2, the first bend 10 preferably is reinforced with a gusset dart 29 that extends between the first foot 2 and the first side member 5. Preferably, the second bend 20 is also reinforced with a gusset dart 29 that extends between the second side member 11 and the second foot 17.

Preferably, the majority of the first foot 2 is substantially planar, and the majority of the second foot 17 is substantially planar. The outer edge 4 of the first foot 2 preferably has first, second and third substantially linear side portions 30, and the outer edge 19 of the second foot 17 has first, second and third substantially linear side portions 30. Preferably, the first foot 2 has a fastener opening 31;

the second foot 17 has a fastener opening 31.

The first foot 2 and the second foot 17 preferably are substantially horizontally-oriented. Preferably, the first side member 5 and the second side member 11 are substantially vertically-oriented.

Preferably, as shown in FIGS. 3 and 4, the first foot 2 and the second foot 17 each have an inner face 32 and an outer face 33 opposite the inner face 32. The first side member 5 and the second side member 11 preferably each have a first face 34 and a second face 35 opposite the first face 34, the first faces 34 facing the same direction and the second faces 35 facing the same direction. Preferably, the inner face 32 of the first foot 2 and the first face 34 of the first side member 5 define a 90-degree angle adjacent the first bend 10. The inner face 32 of the second foot 17 and the second face 35 of the second side member 11 preferably define and 90-degree angle adjacent the second bend 20.

The anchor bolt connection 101 preferably comprises a sheet metal anchor bolt holder 1 and an anchor bolt 102. The sheet metal anchor bolt holder 1 preferably has a first foot 2, a first side member 5, a second side member 11, a second foot 17, and a plurality of arched rib bands 16 that connect the first side member 5 and the second side member 11.

Preferably, the first foot 2 has an inner edge 3 and an outer edge 4. Preferably, the first side member 5 has a bottom edge 6, an inner side edge 7, an outer side edge 8, and a top edge 9. The first side member 5 preferably is integrally joined to the first foot 2 along a first bend 10 at least partially coincident with the bottom edge 6 of the first side member 5 and the inner edge 3 of the first foot 2.

Preferably, the second side member 11 has a bottom edge 12, an inner side edge 13 facing the inner side edge 7 of the first side member 5, an outer side edge 14 facing away from the outer side edge 8 of the first side member 5, and a top edge 15. The second side member 11 preferably is integrally joined to the first side member 5 by a plurality of arched rib bands 16. Preferably, the second foot 17 has an inner edge 18 and an outer edge 19. The second foot 17 preferably is integrally joined to the second side member 11 along a second bend 20 at least partially coincident with the bottom edge 12 of the second side member 11 and the inner edge 18 of the second foot 17.

The arched rib bands 16 preferably each have a first end 21 and a second end 22, an upper edge 23 and a lower edge 24, a generally concave inner side 25 and a generally convex outer side 26. Preferably, the upper edge 23 and second lower edge 24 both extend from the first end 21 to the second end 22. The first end 21 preferably is integrally joined to the inner side edge 7 of the first side member 5 and the second end 22 being integrally joined to the inner side edge 13 of the second side member 11. Preferably, the arched rib bands 16 alternately arch in opposite directions to define an anchor-receiving space 27 encompassed by the generally concave inner sides 25. The anchor bolt 102 preferably has a first end portion 103 inserted in the anchor-receiving space 27 so that the anchor bolt 102 interfaces with the generally concave inner sides 25 of the arched rib bands 16.

Preferably, the first end portion 103 of the anchor bolt 102 is threaded. A first nut 104 preferably is threaded onto the first end portion 103 so that it contacts the sheet metal anchor bolt holder 1. The nut 104 increases the pullout resistance of the anchor bolt 102.

The outer faces 33 of the first foot 5 and the second foot 17 preferably interface with a structural support surface 105.

Preferably, the anchor bolt holder 1, the anchor bolt 102 and the nut 104 are embedded in a concrete structural member 106.

Preferably, the maximum width between the outer edge 4 of the first foot 2 and the outer edge 19 of the second foot 17 is 3 3/32 inches. The maximum height between the upward-facing inner faces 32 of the first and second feet 2 and 17 to the top edges 9 and 15 of the first and second side members 5 and 11 is preferably 3¼ inches. Preferably, the distance between the inner face 32 of the second foot 17 and the lower edge 24 of the nearest rib band 16 is 1¼ inches. The distance between the upper edge 23 and the lower edge 24 of each rib band preferably is ½ inch. Preferably, the anchor-receiving space 27 is generally cylindrical, with a diameter of approximately 1.125 inches. The distance between the outer side edges 8 and 14 of the first and second side member 5 and 11 to the middle of the nearest gusset 29 preferably is 11/16 inches. Preferably, the maximum distance from the inner edge 3 to the outer edge 4 of the first foot 2 is 1½ inches. Preferably, the maximum distance from the inner edge 18 to the outer edge 19 of the second foot 17 is also 1½ inches. The distance from the outer side edge 8 of the first side member 5 to the outer side edge 14 of the second side member 11 preferably is 3⅛ inches. Preferably, the distance from the outer side edges 8 and 14 of the first and second side members 5 and 11 to the middle of the adjacent stiffening embossments 28 is 5/16 inches. The distance from the outer side edges 8 and 14 of the first and second side members 5 and 11 to the inner side edges 7 and 13 where the rib bands 16 attach preferably is 27/32 inches. The inner side edges 7 and 13 are preferably parallel and relatively distantly spaced where the rib bands 16 attach, then colinear, than relatively closely spaced as they approach the bottom edges 6 and 12 of the first and second side members 5 and 11. The embossments 28 preferably begin at the top edges 9 and 15 of the first and second side members 5 and 11, and extend straight down 3.031 inches.

I claim:

1. An anchor bolt connection (101) comprising:

(a) an anchor bolt (102) with a first end portion (103) embedded in a concrete structural member (106) with a portion of the anchor bolt protruding from the top surface of said concrete structural member (106);

(b) a sheet metal anchor bolt holder (1) having:

i. a first foot (2) disposed below the first end portion (103) of said anchor bolt (102) with the first end portion (103) of the anchor bolt (102) disposed between a top surface of said concrete structural member (106) and the first foot (2) of the anchor bolt holder (1);

ii. a first side member (5), having a bottom edge (6), an inner side edge (7) separate from said first foot, an outer side edge (8) separate from said first foot, and a top edge (9) separate from said first foot and disposed oppositely from said bottom edge (6);

iii. a second side member (11), having a bottom edge (12), an inner side edge (13) separate from said first foot and facing said inner side edge (7) of said first side member (5), an outer side edge (14) separate from said first foot and facing away from said outer side edge (8) of said first side member (5), and a top edge (15) separate from said first foot and disposed oppositely from said bottom edge (12), said second side member (11) being integrally joined to said first side member (5) wherein:

A. said first foot (2) is joined to at least one of said first side member (5) and said second side member (11);

B. a first plurality of arms (36) project from said inner side edge (7) of said first side member (5), said arms (36) each having an inner side (25) and an outer side (26);

C. a second plurality of arms (36) project from said inner side edge (13) of said second side member (11), said arms (36) of said second side member (11) each having an inner side (25) and an outer side (26); and said inner sides (25) of said first and second pluralities of arms (36) embrace said first end portion (103) of said anchor bolt (102) and thereby define an anchor-receiving space (27) and wherein D. portions of either of said first and second side members (5) and (11) are disposed below said anchor receiving space and said first end portion (103) of the anchor bolt (102) such that said portions of either of said first and second side members (5) and (11) are farther away from said top surface of said concrete structural member (106) than said first end portion (103) of said anchor bolt (102), and said first end portion (103) of the anchor bolt (102) rests on a portion of either of said first and second side members (5) and (11) disposed below said anchor receiving space, and additional portions of both said first and second side members (5) and (11) are disposed along side said anchor receiving space and said anchor bolt (102) and are disposed closer to the top surface of said concrete structural member (106) than said first end portion (103) of the anchor bolt (102).

2. The anchor bolt connection (101) of claim 1, wherein:

a. said first foot (2) has an inner edge (3) and an outer edge (4); and b. said first foot (2) is integrally joined to one of said first side member (5) and said second side member (11).

3. The anchor bolt connection (101) of claim 2, wherein:

(a). said first foot (2) is integrally joined to one of said first side member (5) and said second side member (11) along a first bend (10);

(b). said first bend (10) is at least partially coincident with at least one of said bottom edge (6) of said first side member (5) and said bottom edge (12) of said second side member (11); and (c). said first bend (10) is at least partially coincident with said inner edge (3) of said first foot (2).

4. The anchor bolt connection (101) of claim 3, wherein:

(a) said sheet metal anchor bolt holder (1) has a second foot (17), having an inner edge (18) and an outer edge (19), wherein:

i. said second foot (17) is integrally joined to one of said first side member (5) and said second side member (11) along a second bend (20);

ii. said second bend (20) is at least partially coincident with one of said bottom edge (6) of said first side member (5) and said bottom edge (12) of said second side member (11); and iii. said second bend (20) is at least partially coincident with said inner edge (18) of said second foot (17).

5. The anchor bolt connection (101) of claim 4, wherein:

(a) said first side member (5) is integrally joined to said first foot (2) along a first bend (10) at least partially coincident with said bottom edge (6) of said first side member (5) and said inner edge (3) of said first foot (2).

6. The anchor bolt connection (101) of claim 5, wherein:

(b) said second foot (17) is integrally joined to said second side member (11) along a second bend (20) at least partially coincident with said bottom edge (12) of said second side member (11) and said inner edge (18) of said second foot (17).

7. The anchor bolt connection (101) of claim 6, wherein:

(a) said first side member (5) is stiffened with an embossment (28) that extends more than half the distance between said bottom edge (6) and said top edge (9) of said first side member (5); and (b) said second side member (11) is stiffened with an embossment (28) that extends more than half the distance between said bottom edge (12) and said top edge (15) of said second side member (11).

8. The anchor bolt connection (101) of claim 7, wherein:

(a) said outer edge (4) of said first foot (2) has first, second and third substantially linear side portions (30);

(b) said outer edge (19) of said second foot (17) has first, second and third substantially linear side portions (30).

9. The anchor bolt connection (101) of claim 8, wherein:

(a) said first foot (2) and said second foot (17) each have an inner face (32) and an outer face (33) opposite said inner face (32);

(b) said first side member (5) and said second side member (11) each have a first face (34) and a second face (35) opposite said first face (34), said first faces (34) facing the same direction and said second faces (35) facing the same direction;

(c) said inner face (32) of said first foot (2) and said first face (34) of said first side member (5) define a 90-degree angle adjacent said first bend (10);

(d) said inner face (32) of said second foot (17) and said second face (35) of said second side member (11) define a 90-degree angle adjacent said second bend (20).

10. The anchor bolt connection (101) of claim 1, wherein:

(a) one of said first plurality of arms (36) is integrally joined to one of said second plurality of arms (36) to form a continuous rib band (16);

(b) another of said first plurality of arms (36) and another of said second plurality of arms (36) is integrally joined to form a continuous rib band (16);

(c) said rib bands (16) each having an inner side (25) and an outer side (26) and said rib bands (16) each have a first end (21) and a second end (22), said first end (21) being integrally joined to said inner side edge (7) of said first side member (5) and said second end (22) being integrally joined to said inner side edge (13) of said second side member (11); and (d) said inner sides (25) of said rib bands (16) define said anchor-receiving space (27).

11. The anchor bolt connection (101) of claim 10, wherein:

(a) said rib bands (16) are arched;

(b) said arched rib bands (16) each have an upper edge (23) and a lower edge (24), said upper edge (23) and said lower edge (24) both extending from said first end (21) to said second end (22);

(c) said inner side (25) is generally concave and said outer side (26) is generally convex; and (d) said arched rib bands (16) alternately arch in opposite directions to define said anchor-receiving space (27) encompassed by said generally concave inner sides (25).

12. The anchor bolt connection (101) of claim 11, wherein:

(a) the majority of said first foot (2) is substantially planar; and (b) the majority of said second foot (17) is substantially planar.

13. The anchor bolt connection (101) of claim 12, wherein:

(a) said first foot (2) and said second foot (17) are substantially horizontally-oriented; and (b) said first side member (5) and said second side member (11) are substantially vertically-oriented.

14. The anchor bolt connection (101) of claim 10, wherein:

(a) said first bend (10) is reinforced with a gusset dart (29) that extends between said first foot (2) and said first side member (5); and (b) said second bend (20) is reinforced with a gusset dart (29) that extends between said second side member (11) and said second foot (17).

15. The anchor bolt connection (101) of claim 14, wherein:

(a) said first foot (2) has a fastener opening (31);

(b) said second foot (17) has a fastener opening (31).

16. An anchor bolt connection (101) comprising:

(a) a concrete structural member (106) with a top surface, (b) a sheet metal anchor bolt holder (1) with:

i. a first foot (2);

ii. a first side member (5), having a bottom edge (6), an inner side edge (7), an outer side edge (8), and a top edge (9);

iii. a second side member (11), having a bottom edge (12), an inner side edge (13) facing said inner side edge (7) of said first side member (5), an outer side edge (14) facing away from said outer side edge (8) of said first side member (5), and a top edge (15), said second side member (11) being integrally joined to said first side member (5) by a plurality of arched rib bands (16), wherein:

A. said first foot (2) is joined to at least one of said first side member (5) and said second side member (11);

B. said arched rib bands (16) each have a first end (21) and a second end (22), an upper edge (23) and a lower edge (24), a generally concave inner side (25) and a generally convex outer side (26), said upper edge (23) and said lower edge (24) both extending from said first end (21) to said second end (22), said first end (21) being integrally joined to said inner side edge (7) of said first side member (5) and said second end (22) being integrally joined to said inner side edge (13) of said second side member (11);

C. said arched rib bands (16) alternately arch in opposite directions to define an anchor-receiving space (27) encompassed by said generally concave inner sides (25) and a portion of either said first and second side members (5) and (11) is disposed below said anchor receiving space; and (c) an anchor bolt (102) embedded in said concrete structural member (106) with a portion of the anchor bolt (102) protruding from said top surface of the said concrete structural member (106),and with a first end portion (103) inserted in said anchor-receiving space (27) so that said anchor bolt (102) interfaces with said generally concave inner sides (25) of said arched rib bands (16) and said anchor bolt (102) rests on a portion of either said first and second side members (5) and (11),and said first foot (2) is disposed below the first end portion (103) of said anchor bolt with the first end portion (103) of the anchor bolt (102) disposed between the top surface of the said concrete structural member (106) and the first first foot (2) of the anchor bolt holder (1), and further portions of either of said first and second side members (5) and (11) are disposed below said anchor receiving space and said first end portion (103) of the anchor bolt (102) such that said portions of either of said first and second side members (5) and (11) are farther away from said top surface of said concrete structural member (106) than said first end portion (103) of said anchor bolt (102), and said first end portion (103) of the anchor bolt (102) rests on a portion of either of said first and second side members (5) and (11) disposed below said anchor receiving space, and additional portions of both said first and second side members (5) and (11) are disposed along side said anchor receiving space and said anchor bolt (102) and are disposed closer to the top surface of said concrete structural member (106) than said first end portion (103) of the anchor bolt (102).

17. The anchor bolt connection (101) of claim 16, wherein:

(a) said first end portion (103) of said anchor bolt (102) is threaded; and (b) a first nut (104) is threaded onto said first end portion (103) so that it contacts said sheet metal anchor bolt holder (1).

18. The anchor bolt connection (101) of claim 17, wherein:

(a) said first foot (5) is formed with an outer face (32) and said outer face (32) of said first foot (5) interfaces with a structural support surface (105).

19. The anchor bolt connection (101) of claim 18, wherein:

(a) said anchor bolt holder (1), said anchor bolt (102) and said nut (104) are embedded in a concrete structural member (106).

* * * * *